United States Patent [19]

Itoh et al.

[11] Patent Number: 4,930,260

[45] Date of Patent: Jun. 5, 1990

[54] CENTERLESS GRINDING APPARATUS OF THROUGH-FEED TYPE

[75] Inventors: Susumu Itoh; Kazuo Satoh; Tomonori Sakuma, all of Fukushima, Japan

[73] Assignee: Akebono Brake Industry Co., Ltd., Tokyo, Japan

[21] Appl. No.: 269,283

[22] Filed: Nov. 10, 1988

[30] Foreign Application Priority Data

Nov. 18, 1987 [JP] Japan ..... 62-176134[U]

[51] Int. Cl.[5] ..... B24B 5/18; B24B 5/22

[52] U.S. Cl. ..... 51/103 TF; 51/238 GG; 51/103 WH

[58] Field of Search ..... 51/102 R, 103 TF, 104, 51/238 GG, 103 WH

[56] References Cited

U.S. PATENT DOCUMENTS

| | | | |
|---|---|---|---|
| 1,663,991 | 3/1928 | Nenninger | 51/103 R |
| 2,093,363 | 9/1937 | Ogilvie | 51/103 TF |
| 4,665,657 | 5/1987 | Rands | 51/103 TF |

FOREIGN PATENT DOCUMENTS

| | | | |
|---|---|---|---|
| 242702 | 9/1969 | U.S.S.R. | 51/103 R |

*Primary Examiner*—Frederick R. Schmidt
*Assistant Examiner*—Bruce P. Watson
*Attorney, Agent, or Firm*—Finnegan, Henderson, Farabow, Garrett and Dunner

[57] ABSTRACT

In a centerless grinding apparatus, a first and a second guide plates are disposed on the side of a grinding wheel, as well as a third and a fourth guide plates are disposed on the side of a regulating feed wheel in parallel relation to the first and second guide plates. The grinding wheel is set to protrude from a guide surface of each of the first and second guide plates by a grinding width, and the regulating feed wheel is set to protrude from a guide surface of each of the third and fourth guide plates by a feed width. The guide surface of each of the third amd fourth guide plates is curved into a curvature equal to a curvature of the outer periphery of the regulating feed wheel.

9 Claims, 6 Drawing Sheets

CENTERLESS GRINDING APPARATUS OF THROUGH-FEED TYPE

BACKGROUND OF THE INVENTION

The present invention relates to a centerless grinding apparatus of the through-feed type in which a work, such as a fluid-operated piston for use in disc brakes, is fed by a regulating feed wheel in a direction of the axis of the work, and an outer peripheral surface of the work is ground by a grinding wheel.

Generally, as shown in FIGS. 1 to 3, a centerless grinding apparatus of the through-feed type comprises a grinding wheel 1 and a regulating feed wheel 2 disposed in opposed position to the grinding wheel 1. In such a conventional centerless grinding apparatus, the regulating feed wheel 2 is inclined with respect to the grinding wheel 1 in a direction of feed so as to feed a work W in the direction of the axis of the work through the rotation of the regulating feed wheel 2. A blade 5 for supporting the work W is provided between the grinding wheel 1 and the regulating feed wheel 2 at a lower position. Further, in order to guide the feed of the work W, guide plates 3A, 4A each in the form of a flat plate are arranged on the work incoming side of the opposed grinding and regulating feed wheels 1 and 2 in parallel relation to each other. Similarly, guide plates 3B, 4B each in the form of a flat plate are arranged on the work outgoing side in parallel relation to each other.

As shown in FIG. 1, the grinding wheel 1 is set to protruded from a guide surface 3*a* of each of the guide plates 3A, 3B by a grinding width having a dimension A, and the regulating feed wheel 2 is set to protrude from a guide surface 4*a* of each of the guide plates 4A, 4B by a feed width having a dimension B. Normally, the grinding width A is set to 0.2 to 0.4 mm, and the feed width B is set to 0.01 to 0.03 mm.

When the work W is guided by the guide plates 3A, 4A and is introduced between the grinding wheel 1 and the regulating feed wheel 2, the work W is rotated and fed in the direction if its axis by the regulating feed wheel 2 protruding by the feed width B. At the same time, the work is ground by the grinding wheel 1, and then the work is guided by the guide plates 3B, 4B and delivered.

With such a conventional apparatus, where it is intended to grind many kinds of works W1, W2 having different diameters, the following problems may be raised.

Here, it is assumed that the spacing between the grinding wheel 1 and the regulating feed wheel 2 as well as the grinding width A1 and the feed width B1 have been set in accordance with the work W1 having greater diameter, as shown in FIG. 2.

In this condition, when the apparatus is to be operated for grinding the work W2 having a smaller diameter, the positional relationship of the parts of the apparatus have to be adjusted because of the differences in diameter between the smaller diameter work W2 and the greater diameter work W1.

In this adjustment, if the guide plates 4A, 4B and the regulating feed wheel 2 are merely moved horizontally toward the grinding wheel 1 with the height of the blade 5 unchanged, a point of contact of the work W2 with the regulating feed wheel 2 must be moved to a lower position by an amount corresponding to the difference in diameter between the smaller diameter work W2 and the greater diameter work W1.

As shown in FIG. 3, at this lowered point of contact, the width B2 of protrusion (feed width) of the regulating feed wheel 2 from the guide surface 4*a* of the guide plate 4A is narrower than the width B1, so that the regulating feed wheel 2 cannot sufficiently apply the force to the work W2. Accordingly, the contact of the work W2 with the grinding wheel 1 becomes uneven, so that a grinding deficiency, that is, failure to obtain roundness of the ground surface, occurs.

Therefore, every time the work W is changed, the adjustment of the positional relationship of the parts of the apparatus, including the adjustment of the height of the blade 5, must be entirely made so as to set the point of contact of the work W with the regulating feed wheel 2 to the optimum position. However, the feed width B is quite small, and conventionally, this adjustment depends on the sense of sight and sensation of the operator and ,therefore, much skill would be required. If an unskillful person makes this adjustment, variations in the adjustment occur, which would raise the above-mentioned grinding deficiency.

SUMMARY OF THE INVENTION

The present invention has been made in view of the problems accompanying the conventional through-feed type centerless grinding method.

Therefore, an object of the present invention is to provide a centerless grinding apparatus of the through-feed type which enables the grinding not subjected to variations in quality, without requiring much skill in the adjustment of the contact point of the guide plate.

The foregoing and other objects have been achieved by the provision of a centerless grinding apparatus of the through-feed type, according to the present invention, is constructed as follows:

In the apparatus according to the present invention, a first and a second guide plates are disposed on the side of a grinding wheel, as well as a third and a fourth guide plates are disposed on the side of a regulating feed wheel in parallel relation to the first and second guide plates. The grinding wheel is set to protrude from a guide surface of each of the first and second guide plates by a grinding width, and the regulating feed wheel is set to protrude from a guide surface of each of the third and fourth guide plates by a feed width. The guide surface of each of the third and fourth guide plates is curved into a curvature equal to a curvature of the outer periphery of the regulating feed wheel.

DESCRIPTION OF THE PREFERRED EMBODIMENT

A centerless grinding apparatus of the through-feed type according to one embodiment of the present invention will now be described with reference to the accompanying drawings.

Figure 1:
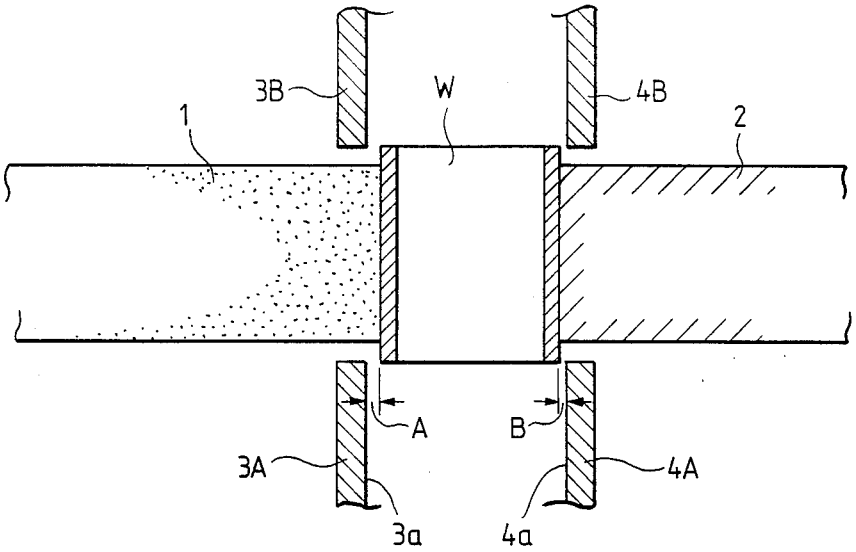
FIG. 1 PRIOR ART
FIG. 1 is a cross sectional plan view of a conventional centerless grinding apparatus.
Figure 3:
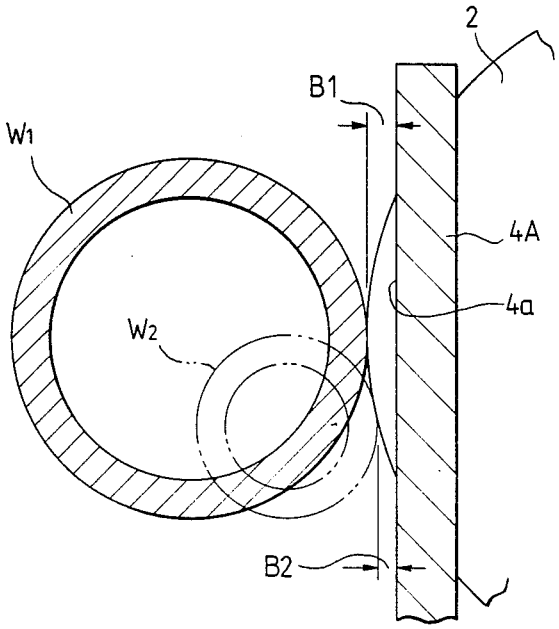
FIG. 3 PRIOR ART
FIG. 3 shows a change in feed width of the regulating feed wheel of a conventional apparatus.
Figure 2:
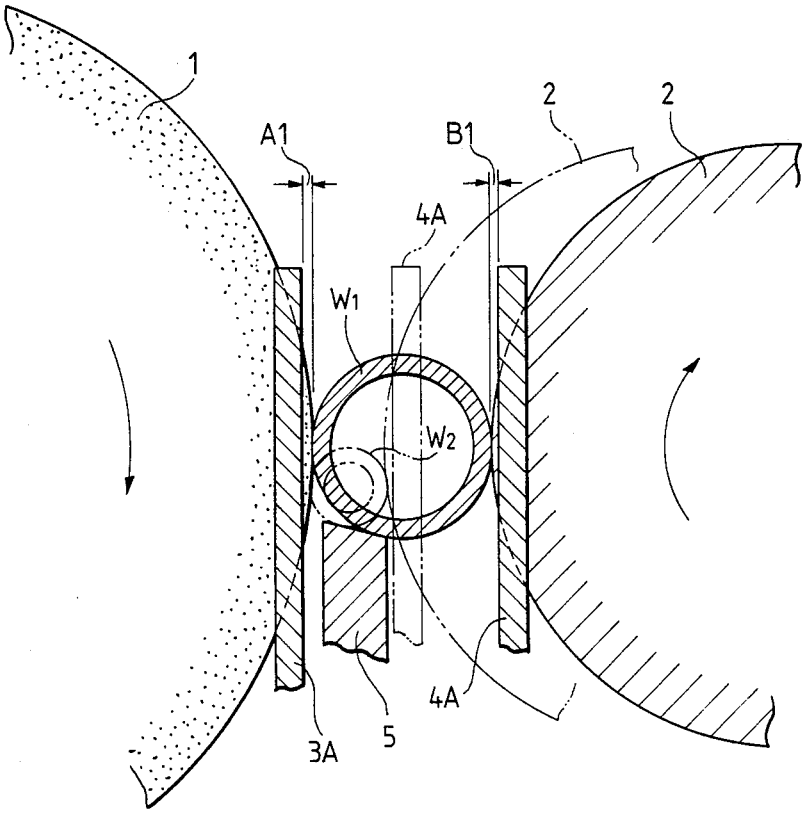
FIG. 2 PRIOR ART
FIG. 2 is a vertical cross sectional front view of the conventional apparatus.
Figure 4:
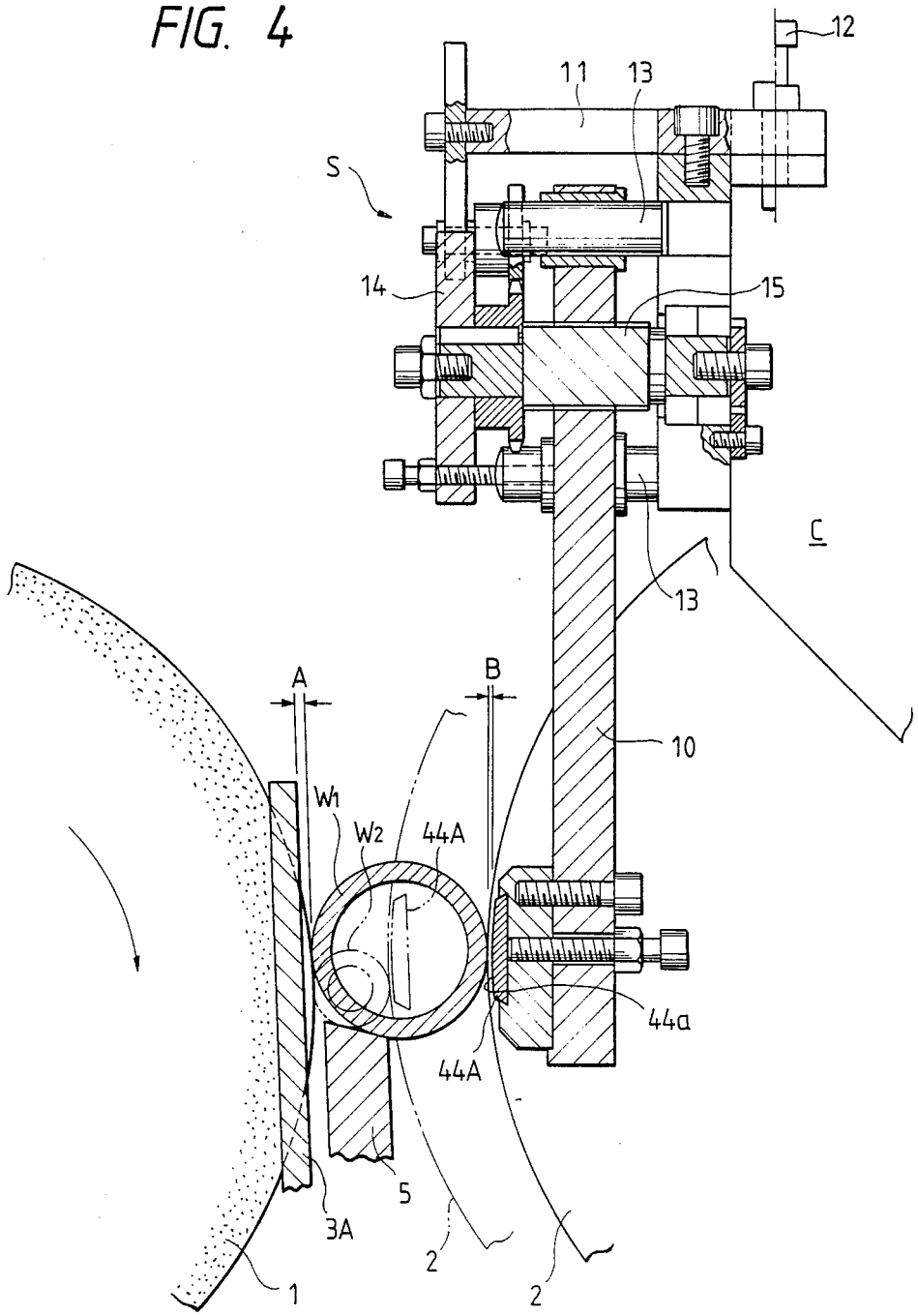
FIG. 4 is a vertical cross sectional front view of a centerless grinding apparatus of the through-feed type according to the present invention.

In FIG. 4, a regulating feed wheel 2 is rotatably mounted on a bed of a grinding machine in opposed position to a rotatable grinding wheel 1 mounted on the bed. An upstanding blade 5 for supporting a work W, (W1, W2) is disposed between the grinding wheel 1 and the regulating feed wheel 2 at a lower position. The height of the blade 5 is adjustable by an adjusting device (not shown). The regulating feed wheel 2 is covered by a cover casing C and is movable toward and away from the grinding wheel 1 together with the cover casing C by means of a sliding device (not shown).

Figure 7:
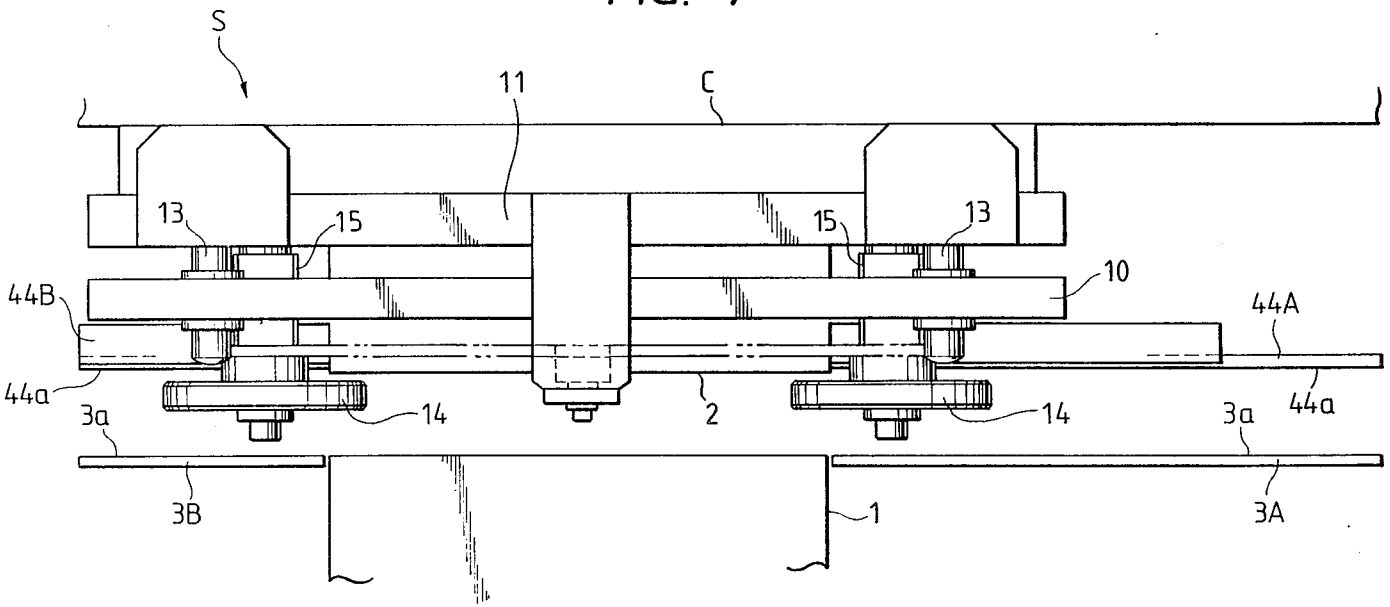
FIG. 7 is a plan view of the mechanism of FIG. 6.

As shown in FIG. 7, on the side of the grinding wheel 1, a first and a second guide plates 3A, 3B each in the form of a flat plate are mounted at a work incoming side and a work outgoing side, respectively. The first and second guide plates 3A, 3B are supported for movement toward and away from the regulating feed wheel 2, and with this movement, the width A of protrusion (grinding width) of the grinding wheel 1 from a guide surface 3*a* of each of the first and second guide plates 3A, 3B is adjustable.

Figure 5:
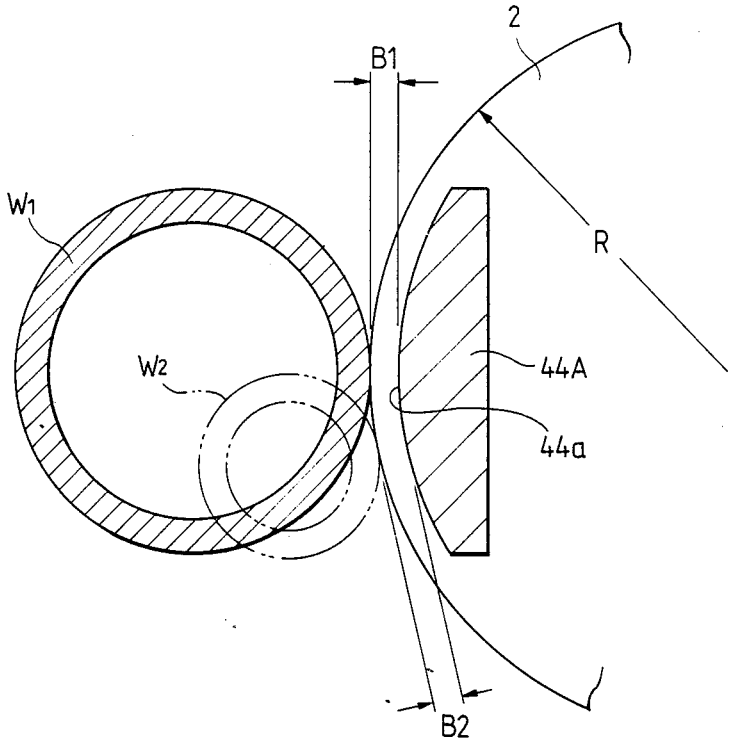
FIG. 5 shows a change in feed width of the regulating feed wheel.
Figure 6:
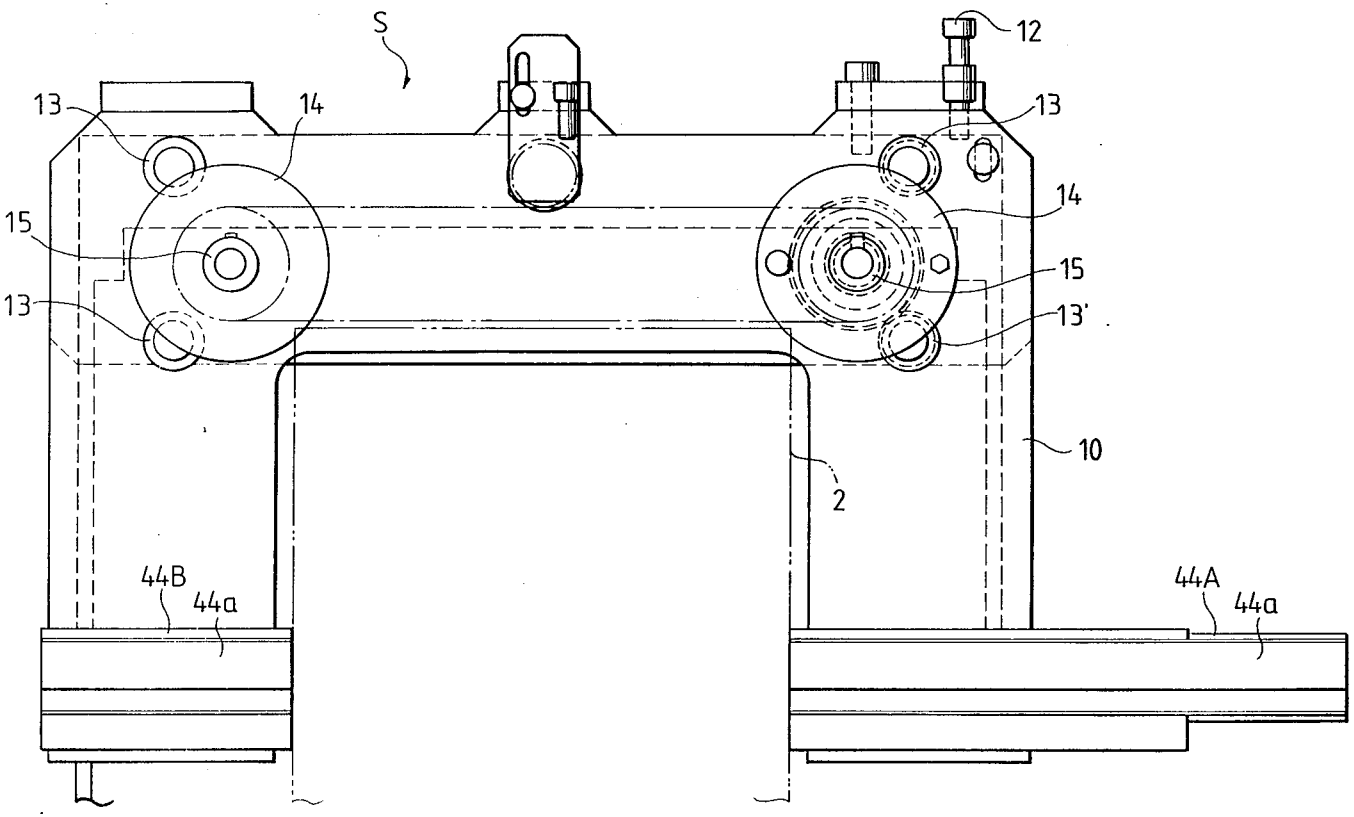
FIG. 6 is a side view showing a positioning mechanism of the present invention.

Also, on the side of the regulating feed wheel 2, a third and a fourth guide plates 44A, 44B are mounted at the work incoming side and the work outgoing side, respectively, in parallel relation to the first and second guide plates 3A, 3B. As shown in FIGS. 4 and 5, a guide surface 44*a* of each of the third and fourth guide plates 44A, 44B is curved into a curvature R equal to a curvature of the outer periphery of the regulating feed wheel 2. The third and fourth guide plates 44A, 44B are mounted on lower ends of a movable arm 10 of a positioning mechanism S fixed to the cover casing C, and the positioning of these guide plates with respect to the regulating feed wheel 2 can be made by the movable arm 10.

The positioning mechanism S will now be described. A chassis 11 is mounted on the cover casing C by an adjusting bolt 12 so as to be vertically movable. A plurality of guide tubes 13 are mounted on the chassis 11 and extend in a direction to connect the grinding wheel 1 and the regulating feed wheel 2 together. The movable arm 10 are slidably mounted on the guide tubes 13. Sliding bolts 15 which are rotatable by handles 14 are threadably engaged with the movable arm 10. As shown in FIG. 7, the movable arm 10 is of an inverted U-shape for straddling the regulating feed wheel 2, and supports at their opposite lower ends the third and fourth guide plates 44A, 44B disposed respectively at the work incoming side and outgoing side.

With respect to the grinding of the work W, the grinding width A has been set to a proper value by adjusting the positions of the first and second guide plates 3A, 3B on the side of the grinding wheel 1. Also, the feed width B of the regulating feed wheel 2 has been set by means of the positioning mechanism S, that is, by vertically moving the chassis 11 by the adjusting bolt 11 to adjust the vertical position of the movable arm 11 and by horizontally moving the movable arm 10 by the handles 14.

Next, the adjustment required when the work W is changed from one W1 of a greater diameter to another W2 of a smaller diameter will now be described.

In this case, the regulating feed wheel 2 is moved toward the grinding wheel 1, with the height of the blade 5 unchanged. As a result, the third and fourth guide plates 44A, 44B on the side of the regulating feed wheel 2 are moved together with the regulating feed wheel 2 through the cover case C and the movable arm 10 of the positioning device S. Then, when the regulating feed wheel 2 is brought into contact with the smaller diameter work W2, the point of contact of the regulating feed wheel 2 with the work W2 is lower than the point of contact thereof with the greater diameter work W1. However, since the guide surface 44*a* of each of the third and fourth guide plates 44A, 44B is curved with the same curvature R as the curvature of the outer periphery of the regulating feed wheel 2, the feed width B2 of the regulating feed wheel 2 at the point of contact with the smaller diameter work W2 is equal to the feed width B1 at the point of contact with the greater diameter work W1.

Therefore, regardless of the diameter of the work W, the contact of the regulating feed wheel 2 with the work W can always be kept constant merely by horizontally moving the regulating feed wheel 2 toward the grinding wheel 1 togther with the third and fourth guide plates 44A, 44B to thereby ensure that the contact of the work W with the grinding wheel is kept uniform.

As described above, in the centerless grinding apparatus of the through-feed type according to the present invention, the guide surface 44*a* of each of the third and fourth guide plates 44A, 44B on the side of the regulating feed wheel 2 is curved with the same curvature R as the curvature of the outer periphery of the regulating feed wheel 2. Therefore once the feed width B of the regulating feed wheel 2 (i.e., width of protrusion) is set, the contact of the regulating feed wheel 2 with the work W at any point along the guide surface 44*a* is substantially uniform.

The reason why the term "substantially uniform" is used here is as follows: In the case where the curvature R of the guide surface 44*a* of each of the third and fourth guide plates 44A, 44B is made equal to the curvature of the outer periphery of the regulating feed wheel 2, and if the third and fourth guide plates 44A, 44B are horizontally displaced or moved to provide the feed width B of the regulating feed wheel 2, strictly speaking, the feed width B is smaller at the central portion of each of the third and fourth guide plates 44A, 44B than at marginal portions thereof. However, the feed width B is usually as small as 0.01 to 0.03 mm, and the curvature R of each of the regulating feed wheel 2 and the guide surface 44*a* is usually 0.02 mm which is large as compared with the feed width B. Therefore, the feed width B can be regarded as being uniform at any point on the guide surface 44*a*.

Therefore, even if the point of contact is changed as a result of changing the diameter of the work W, the feed width of the regulating feed wheel 2 at that point of contact will not be changed, so that the contact of the work W with the grinding wheel 1 will not be changed by the exchange of the work W.

Thus, when the work W is exchanged, the adjustment of the contact point can be effected at least by moving or displacing the regulating feed wheel 2 toward the grinding wheel 1 together with the third and fourth guide plates 44A, 44B.

That is, in accordance with a plurality of kinds of works W of different diameters, the positioning with respect to the work W can be made merely by horizontally moving the regulating feed wheel 2 together with the third and fourth guide plates 44A, 44B. Therefore, much skill is not required for the adjustment and, hence, the adjustment can be carried out easily.

In addition, since the contacting condition is uniform, the contact of the work W with the grinding wheel 1 will not become uneven, and the grinding can be carried out uniformly also in terms of quality.

What is claimed is:

1. A centerless grinding apparatus for grinding a work, comprising:

a grinding wheel;

a regulating feed wheel disposed at an opposed position to said grinding wheel;

a first and second guide plates provided at a side of said grinding wheel, said first and second guide plates having a first guide surface from which said grinding wheel protrudes by a grinding width; and a third and fourth guide plates provided at a side of said regulating feed wheel, said third and fourth guide plates having a second guide surface from which said regulating feed wheel protrudes by a feed width, said second guide surface being curved into a curvature equal to a curvature of the outer periphery of said regulating feed wheel, wherein the work is guided by said first to fourth guide plates and introduced between said grinding wheel and said regulating feed wheel whereby feeding the work in a direction of the axis of said work.

2. The centerless grinding apparatus of claim 1, further comprising a blade provided between said grinding wheel and said regulating feed wheel, said blade supporting said work.

3. The centerless grinding apparatus of claim 2, wherein the height of said blade is adjustable.

4. The centerless grinding apparatus of claim 1, further comprising a cover casing for covering said regulating feed wheel.

5. The centerless grinding apparatus of claim 4, wherein said regulating feed wheel is movable toward and away from said grinding wheel together with said cover casing.

6. The centerless grinding apparatus of claim 4, wherein said cover case comprises a positioning device for said third and fourth guide plates.

7. The centerless grinding apparatus of claim 6, wherein said positioning device comprises a movable arm movable in both vertical and horizontal directions, and said third and fourth guide plates are fixedly secured to a lower end of said movable arm.

8. The centerless grinding apparatus of claim 7, wherein said movable arm is formed in an inverted U-shape for straddling said regulating feed wheel, and said third and fourth guide plates are fixedly secured to both lower ends of said movable arm.

9. The centerless grinding apparatus of claim 1, wherein said work is a fluid-operated piston for use in disc brakes.

* * * * *